US010195877B2

(12) United States Patent
Sakano

(10) Patent No.: US 10,195,877 B2
(45) Date of Patent: Feb. 5, 2019

(54) TAPE CARTRIDGE

(71) Applicant: Seiko Epson Corporation, Tokyo (JP)

(72) Inventor: Hideki Sakano, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/003,429

(22) Filed: Jun. 8, 2018

(65) Prior Publication Data

US 2018/0290467 A1 Oct. 11, 2018

Related U.S. Application Data

(63) Continuation of application No. 15/837,457, filed on Dec. 11, 2017, now Pat. No. 10,022,992, which is a (Continued)

(30) Foreign Application Priority Data

Oct. 16, 2014 (JP) ..... 2014-212039

(51) Int. Cl.
*B41J 15/04* (2006.01)
*B41J 3/407* (2006.01)
*B41J 32/00* (2006.01)

(52) U.S. Cl.
CPC ..... *B41J 15/044* (2013.01); *B41J 3/4075* (2013.01); *B41J 32/00* (2013.01)

(58) Field of Classification Search
CPC ... B41J 3/4075; B41J 3/36; B41J 2/325; B41J 15/044; B41J 32/00
See application file for complete search history.

(56) References Cited

U.S. PATENT DOCUMENTS 5,707,159 A 1/1998 Yamamoto et al.
2010/0166475 A1 7/2010 Yamaguchi et al.
(Continued)

FOREIGN PATENT DOCUMENTS

CN 103753979 A 4/2014
JP 2005-088597 A 4/2005
(Continued)

OTHER PUBLICATIONS

Non-Final Office Action received in U.S. Appl. No. 15/042,027, dated May 2, 2016.
(Continued)

*Primary Examiner* — Bradley Thies
(74) *Attorney, Agent, or Firm* — ALG Intellectual Property, LLC

(57) ABSTRACT

A tape cartridge is mounted on a mounting section of a tape printer, which has an identification portion configured to identify a type of cartridge containing a tape-shaped printing medium. The tape cartridge includes a tape roll around which the tape-shaped printing medium is wound, a core shaft portion that is formed into a fitting cylindrical shape and has a rotation shaft of the tape roll, an identification concave portion that is provided in an inner peripheral portion of the core shaft and engages with the identification portion, a depressed portion that engages with a pedestal which is disposed on the mounting section, and a core concave portion that includes the identification concave portion and the depressed portion. The identification concave portion is configured to accommodate the identification portion in a state where the tape cartridge is mounted on the mounting section.

3 Claims, 13 Drawing Sheets

Related U.S. Application Data continuation of application No. 15/663,449, filed on Jul. 28, 2017, now Pat. No. 9,914,315, which is a continuation of application No. 15/380,852, filed on Dec. 15, 2016, now Pat. No. 9,751,345, which is a continuation of application No. 15/042,027, filed on Feb. 11, 2016, now Pat. No. 9,555,654, which is a continuation of application No. PCT/JP2015/071890, filed on Jul. 31, 2015.

(56) References Cited

U.S. PATENT DOCUMENTS

| | | | | |
|---|---|---|---|---|
| 2010/0166477 | A1 | 7/2010 | Yamaguchi et al. | |
| 2010/0166478 | A1 | 7/2010 | Yamaguchi et al. | |
| 2010/0166479 | A1 | 7/2010 | Yamaguchi et al. | |
| 2010/0166480 | A1 | 7/2010 | Yamaguchi et al. | |
| 2010/0247205 | A1 | 9/2010 | Yamaguchi et al. | |
| 2010/0247206 | A1 | 9/2010 | Yamaguchi et al. | |
| 2010/0254742 | A1 | 10/2010 | Yamaguchi et al. | |
| 2011/0036501 | A1 | 2/2011 | Sakano | |
| 2012/0080550 | A1 | 4/2012 | Yamaguchi et al. | |
| 2013/0089366 | A1* | 4/2013 | Kosuge | B41J 15/044 400/613 |
| 2013/0114988 | A1 | 5/2013 | Sodeyama | |
| 2013/0142560 | A1 | 6/2013 | Yamaguchi et al. | |
| 2013/0221149 | A1 | 8/2013 | Sodeyama | |
| 2013/0315644 | A1 | 11/2013 | Yamaguchi et al. | |
| 2014/0112694 | A1 | 4/2014 | Yamaguchi et al. | |
| 2014/0175204 | A1 | 6/2014 | Yamaguchi et al. | |
| 2014/0199108 | A1 | 7/2014 | Yamaguchi et al. | |
| 2014/0204170 | A1 | 7/2014 | Yamaguchi et al. | |
| 2014/0205341 | A1 | 7/2014 | Yamaguchi et al. | |
| 2014/0205342 | A1 | 7/2014 | Yamaguchi et al. | |
| 2014/0205343 | A1 | 7/2014 | Yamaguchi et al. | |
| 2014/0205344 | A1 | 7/2014 | Yamaguchi et al. | |
| 2014/0205345 | A1 | 7/2014 | Yamaguchi et al. | |
| 2014/0205346 | A1 | 7/2014 | Yamaguchi et al. | |
| 2014/0205347 | A1 | 7/2014 | Yamaguchi et al. | |
| 2014/0205348 | A1 | 7/2014 | Yamaguchi et al. | |
| 2014/0205349 | A1 | 7/2014 | Yamaguchi et al. | |
| 2014/0205350 | A1 | 7/2014 | Yamaguchi et al. | |
| 2014/0205352 | A1 | 7/2014 | Yamaguchi et al. | |
| 2014/0205353 | A1 | 7/2014 | Yamaguchi et al. | |
| 2014/0320581 | A1 | 10/2014 | Yamaguchi et al. | |
| 2015/0174932 | A1 | 6/2015 | Yamaguchi et al. | |
| 2015/0191025 | A1 | 7/2015 | Sodeyama | |
| 2015/0298476 | A1 | 10/2015 | Yamaguchi et al. | |
| 2016/0039230 | A1 | 2/2016 | Yamaguchi et al. | |
| 2016/0368284 | A1 | 12/2016 | Yamaguchi et al. | |
| 2017/0008318 | A1 | 1/2017 | Yamaguchi et al. | |
| 2017/0100948 | A1 | 4/2017 | Yamaguchi et al. | |
| 2018/0099517 | A1 | 4/2018 | Yamaguchi et al. | |
| 2018/0141349 | A1 | 5/2018 | Yamaguchi et al. | |
| 2018/0257400 | A1 | 9/2018 | Yamaguchi et al. | |

FOREIGN PATENT DOCUMENTS

| | | | |
|---|---|---|---|
| JP | 2006-225112 | A | 8/2006 |
| JP | 2011-245757 | A | 12/2011 |
| JP | 2012-020543 | A | 2/2012 |

OTHER PUBLICATIONS

Notice of Allowance and Notice of Allowability received in U.S. Appl. No. 15/042,027, dated Sep. 19, 2016.

Notice of Allowance and Notice of Allowability received in U.S. Appl. No. 15/380,852, dated May 4, 2017.

Notice of Allowance and Notice of Allowability received in U.S. Appl. No. 15/663,449, dated Oct. 4, 2017.

Notice of Allowance and Notice of Allowability received in U.S. Appl. No. 15/837,457, dated Mar. 16, 2018.

* cited by examiner

TAPE CARTRIDGE

CROSS REFERENCE TO RELATED APPLICATION

The present application is a continuation application of U.S. patent application Ser. No. 15/837,457 filed on Dec. 11, 2017, which is a continuation of U.S. patent application Ser. No. 15/663,449 filed on Jul. 28, 2017 (now U.S. Pat. No. 9,914,315), which is a continuation of U.S. patent application Ser. No. 15/380,852 filed on Dec. 15, 2016 (now U.S. Pat. No. 9,751,345), which is a continuation of U.S. patent application Ser. No. 15/042,027 filed Feb. 11, 2016 (now U.S. Pat. No. 9,555,654), which is a continuation application of International Application No. PCT/JP2015/071890 filed Jul. 31, 2015, which claims priority from Japanese Patent Application No. 2014-212039 filed Oct. 16, 2014, each of which are expressly incorporated by reference herein.

BACKGROUND

1. Technical Field

The present invention relates to a tape cartridge which is mounted on a cartridge mounting section of a tape printer and is used for printing by the tape printer.

2. Background Art

The following configuration has been known as a tape cartridge in the related art which is mounted on a cartridge mounting section of a tape printer (JP-A-2012-20543).

The tape cartridge includes a tape body in which a print tape is wound around a tape core, a ribbon body in which an ink ribbon is wound around a ribbon feeding core, a ribbon winding core around which a used ink ribbon is wound, a platen roller which feeds and conveys the print tape from the tape core, and a cartridge case which receives the tape body, the ribbon body, the ribbon winding core, and the platen roller.

The cartridge case has a lower case as a seat side and an upper case corresponding to the lower case. In the lower case, a hollow tape bearing portion that rotatably supports the tape body is integrally formed. The center of the tape bearing portion (tape body) and the center of the platen roller are disposed to cross an imaginary line connecting two gripping portions of the cartridge case when viewed in a mounting direction.

When the tape cartridge is mounted on the cartridge mounting section, the tape bearing portion, the platen roller, and the ribbon wind core engage with (are fitted to) a positioning protrusion of the cartridge mounting section, a platen drive shaft, and a ribbon winding drive shaft, respectively.

In such a tape cartridge according to the related art, since the tape body is the heaviest among elements of the tape cartridge, there is a high possibility of being supported to be inclined. That is, when the tape cartridge is gripped with a finger in mounting the tape cartridge, there is a high possibility that a side on which the tape roll is disposed is likely to be inclined due to gravity unless the tape cartridge is consciously gripped to be horizontal. For this reason, in the tape cartridge according to the related art, there is a high possibility that the tape bearing portion will begin to be fitted to the positioning protrusion prior to fitting of the platen roller to the platen drive shaft. Therefore, unless the tape bearing portion is accurately positioned with respect to the positioning protrusion, there is a problem in that the operation of mounting the tape cartridge is troublesome, such that the platen roller is stuck in the platen drive shaft, fine adjustment of fingertips is forced, or the like.

An object of the present invention is to provide a tape cartridge capable of easily being mounted on a mounting section of a tape printer.

SUMMARY OF THE INVENTION

A tape cartridge of the present invention is mounted on a mounting section of a tape printer having a print head configured to perform a printing operation on a tape-shaped printing medium, a drive shaft configured to provide a conveying force to the printing medium, and an identification portion configured to identify a type of a cartridge containing the printing medium, the tape cartridge including: a tape roll around which the printing medium is wound; a platen roller that includes a first fitting portion which is fitted to the drive shaft when the tape cartridge is mounted on the mounting section of the tape printer; and a second fitting portion that is disposed at the center of the tape roll in an axial direction of the tape roll and is fitted to the identification portion when the tape cartridge is mounted on the mounting section of the tape printer; wherein when the tape cartridge is mounted on the mounting section of the tape printer, the second fitting portion is disposed in a depressed portion facing the mounting section.

According to this configuration, when the tape cartridge is mounted, the second fitting portion is disposed in a depressed portion, that is, a recessed portion, facing the mounting section of the tape printer. For this reason, when the tape cartridge is mounted, the identification portion abuts against the depressed portion to correct a posture of the cartridge prior to the beginning of fitting of the second fitting portion to the identification portion of the tape printer. Accordingly, prior to the beginning of fitting of the second fitting portion to the identification portion, the first fitting portion can begin to be fitted to the drive shaft of the tape printer. In other words, even though the mounting is started in a posture in which the tape cartridge is inclined to the second fitting portion in mounting the tape cartridge, it is possible to increase a possibility that fitting of the first fitting portion will be started.

Accordingly, it is possible to suppress a problem in that the first fitting portion is stuck in the drive shaft or the like. Since the first fitting portion begins to be fitted prior to the second fitting portion, it may be possible to correct an inclination or a position of the tape cartridge in mounting. By forming a timing difference between the beginning of fitting of the first fitting portion and the beginning of fitting of the second fitting portion, an impact force at the time of mounting can be dispersed. As a result, it is possible to smoothly mount the tape cartridge on the mounting section of the tape printer.

Since the second fitting portion is disposed in the depressed portion, the second fitting portion can be substantially shortened to have an appropriate strength. The second fitting portion is also less likely to receive a direct impact force in drop impact or the like, and thus the second fitting portion can be configured to have a structure not being easily broken. Besides, even though the second fitting portion has a protrusion or the like, the protrusion or the like does not protrude from an external surface of the tape cartridge due to the depressed portion and thus the protrusion or the like does not interfere with piling of tape cartridges.

The second fitting portion which is fitted to the identification portion may use a combination of a convex shape as well as a concave shape, whereby it is possible to diversify (identify the types) fitting combinations.

It is preferable that the cartridge type not be a so-called tape type, but a specification type or a forwarding type (by country or by OEM) of the tape cartridge.

In this case, it is preferable that the identification portion of the tape printer include an actuated portion which is identified and actuated and the second fitting portion include an actuating portion which actuates the actuated portion of the identification portion.

In this case, it is preferable that the actuating portion be a protruding portion which is convex in a mounting direction.

According to this configuration, it is possible to identify the tape cartridge and to detect that the tape cartridge is properly mounted by only mounting the tape cartridge on the mounting section of the tape printer. It is possible to simplify a structure on an identification portion side of the tape printer. The actuating portion may not be a protrusion which is convex in the mounting direction, but a concave portion which is concave in the mounting direction.

It is preferable that a position or a shape of the actuating portion vary depending on the type of the cartridge.

According to this configuration, it is possible to reliably identify the tape cartridge having different types.

It is also preferable that an axial direction of the platen roller, an axial direction of the tape roll, and a cartridge mounting/demounting direction be parallel to each other.

According to this configuration, it is possible to smoothly perform an operation of demounting the tape cartridge without feeling discomfort as long as the cartridge mounting/demounting direction is not false.

It is preferable that the second fitting portion be closer to a center of the tape cartridge than the first fitting portion is in the axial direction of the tape roll.

According to this configuration, for example, when the actuating portion which actuates the identification portion of the tape printer is provided in the second fitting portion, a lift of the tape cartridge due to vibration or the like during operation of the tape printer is not likely to occur and it is thus possible to prevent an erroneous operation of the identification portion. When viewed from the gravity direction, the second fitting portion is three-dimensionally close to the center as well as two-dimensionally close to the center. Accordingly, compared to a configuration in which the second fitting portion is provided in an area having no depressed portion, it is possible to effectively suppress vibration during operation.

It is preferable that the first fitting portion have a guide shape for fitting the drive shaft.

According to this configuration, in mounting the tape cartridge, it is possible to suppress a problem that the first fitting portion is stuck in the drive shaft or the like and thus to smoothly fit the first fitting portion to the drive shaft.

Meanwhile, in mounting the tape cartridge, it is preferable that the first fitting portion be likely to be fitted to the drive shaft prior to beginning of fitting of the second fitting portion to the identification portion.

According to this configuration, an inclination or a position of the tape cartridge can be corrected at the beginning of mounting the tape cartridge. An impact force at the time of mounting can be dispersed. Accordingly, it is possible to smoothly mount the tape cartridge on the mounting section of the tape printer.

It is preferable that a movement stroke from fitting of the first fitting portion to the drive shaft to completing of the fitting is longer than a movement stroke from fitting of the second fitting portion to the identification portion to completing of the fitting.

According to this configuration, since the inclination of the tape cartridge is corrected by fitting the first fitting portion to the drive shaft, a wrench or the like does not occur in fitting the second fitting portion to the identification portion and it is thus possible to smoothly mount the tape cartridge on the mounting section of the tape printer.

It is preferable that the drive shaft have a spline shaft portion and the first fitting portion have a spline boss portion corresponding to the spline shaft portion.

According to this configuration, it is possible to make the drive unit and the platen roller transmit a driving force by only mounting the tape cartridge on the mounting section of the tape printer.

In this case, it is preferable that the number of grooves of the spline boss portion be greater than the number of teeth of the spline shaft portion.

In the same manner, it is preferable that intervals of a plurality of grooves of the spline boss portion be larger than intervals of a plurality of teeth of the spline shaft portion.

According to this configuration, it is possible to decrease a contact area between the spline boss portion and the spline shaft portion and to decrease a mounting load of the tape cartridge. As a result, it is possible to smoothly mount the tape cartridge on the mounting portion of the tape printer can.

When the axial direction of the platen roller coincides with a gravity direction, it is preferable that a lower end of the first fitting portion is positioned to be lower than a lower end of the second fitting portion.

According to this configuration, it is possible to enhance a possibility of beginning to fit the first fitting portion to the drive unit prior to beginning to fit the second fitting portion to the identification portion. As a result, an inclination or a position of the tape cartridge can be corrected at the beginning of mounting the tape cartridge. An impact force at the time of mounting can be dispersed. Accordingly, it is possible to smoothly mount the tape cartridge on the mounting section of the tape printer.

DETAILED DESCRIPTION OF THE EMBODIMENTS

Hereinafter, a tape cartridge according to an embodiment of the present invention along with a tape printer on which the tape cartridge is mounted will be described with reference to the accompanying drawings. The tape printer performs a printing operation by feeding a print tape and an ink ribbon from the mounted tape cartridge and makes a label (a tape piece) by disconnecting a part, which has been used in the printing operation, of the print tape.

[Overview of Tape Printer]

Figure 1:
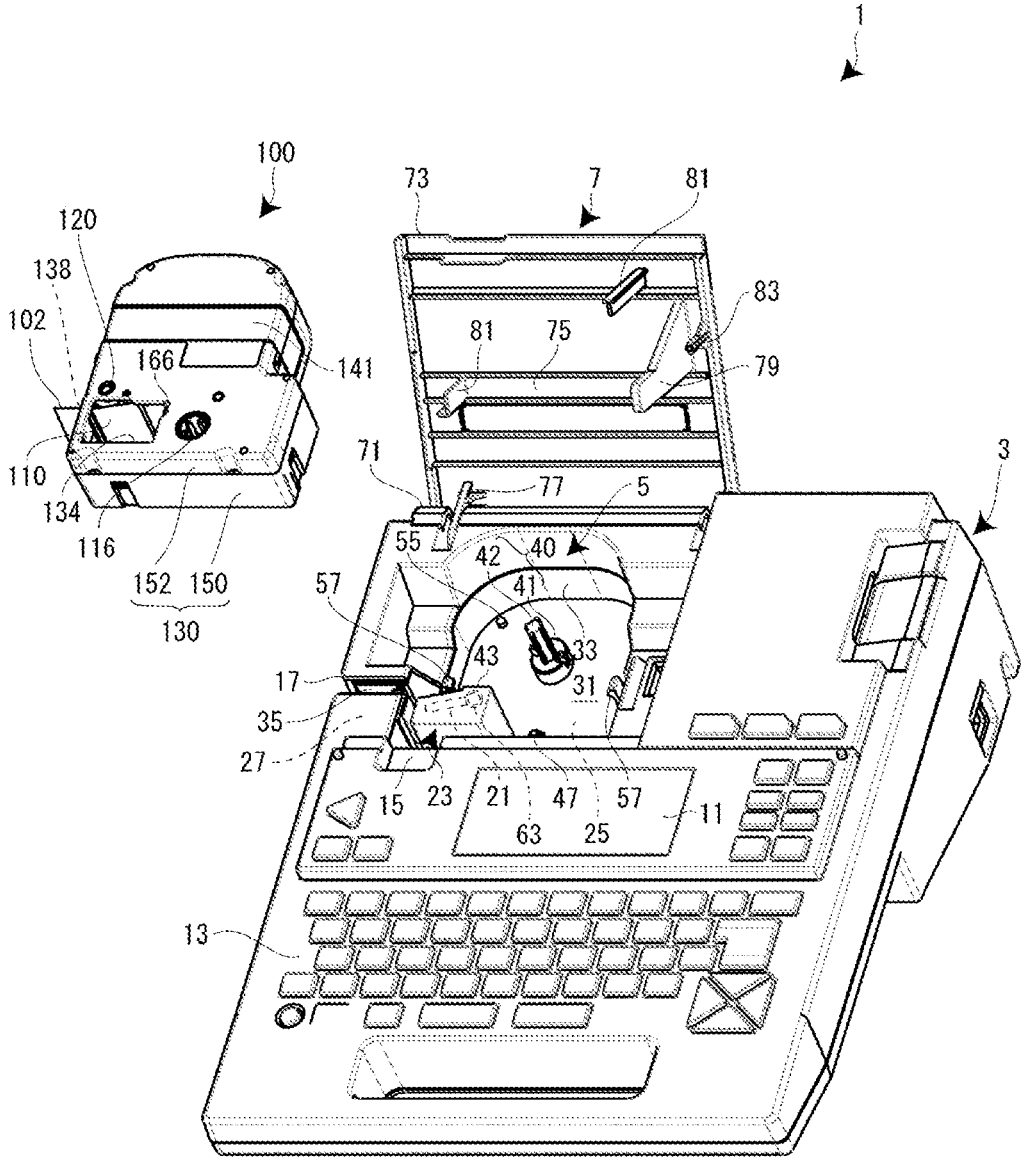
FIG. 1 is an external perspective view illustrating a lid-open state of a tape printer according to an embodiment.

FIG. 1 is an external perspective view of a tape printer and a tape cartridge mounted on the tape printer. As illustrated in FIG. 1, a tape printer 1 includes a device case 3 constituting an outer shell, a cartridge mounting section 5 on which a tape cartridge 100 is detachably mounted, and an openable lid 7 which opens and closes the cartridge mounting section 5. In an upper surface of the device case 3, the cartridge mounting section 5 is provided on a deep side, a display 11 is provided at the center, and a keyboard 13 is provided on a near side. A hollow input portion 15 for hooking a finger is provided in the vicinity of the openable lid 7, and thus the openable lid 7 is splashed to be opened through the hollow input portion 15. A tape discharge port 17 which has a longitudinally-long shape and through which a print tape 102 is discharged is provided on a side surface (left side surface) of the device case 3.

In the tape printer 1, a print mechanism unit 23 having a print head 21 erectly disposed in the cartridge mounting section 5, a tape feeding mechanism unit 25 built in the other area of the cartridge mounting section 5, and a tape cutting mechanism unit 27 built in the vicinity of the tape discharging port 17 are provided.

A user inputs print information from the keyboard 13, confirms the print information on the display 11, and then performs printing by operating keys. When a print instruction is issued, the tape feeding mechanism unit 25 is driven to drive the print tape 102 and an ink ribbon 110 to run in parallel, and thus print using thermal transfer is performed in the print mechanism unit 23. The print tape 102 is discharged via the tape discharging port 17 by this print feeding, and, when printing is completed, the tape cutting mechanism unit 27 is driven to disconnect a part, for which the printing is done, from the print tape 102.

[Overview of Tape Cartridge]

As illustrated in FIGS. 2A to 2F and 7A to 7B, the tape cartridge 100 includes a tape roll 106 in which the print tape 102 is wound around a tape core 104, and a ribbon roll 114 in which the ink ribbon is wound around a feeding core 112. The tape cartridge 100 also includes a winding core 116 winding the ink ribbon 110 after use, and a platen roller 120 (platen) being in contact with a print head 21 via the ink ribbon 110 and the print tape 102 and conveying the print tape 102 and the ink ribbon 110. The tape cartridge 100 includes a cartridge case 130 holding the tape roll 106, the ribbon roll 114, a winding core 116, and the platen roller 120. As described above, the tape cartridge 100 of this embodiment has a so-called shell structure of which an outer shell is covered with the cartridge case 130.

Figure 4A:
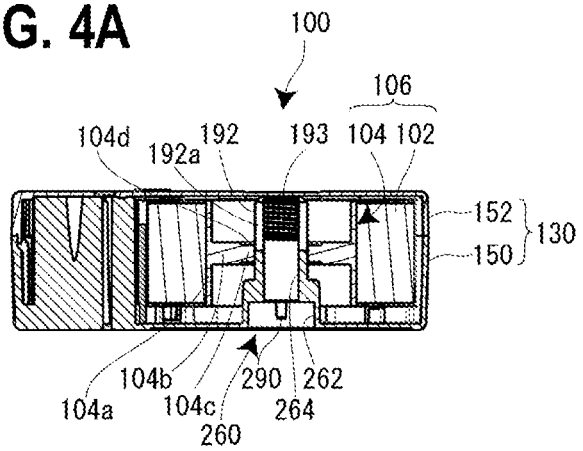
FIG. 4A illustrates a cross-sectional view taken along line A-A in FIGS. 2A
Figure 4B:
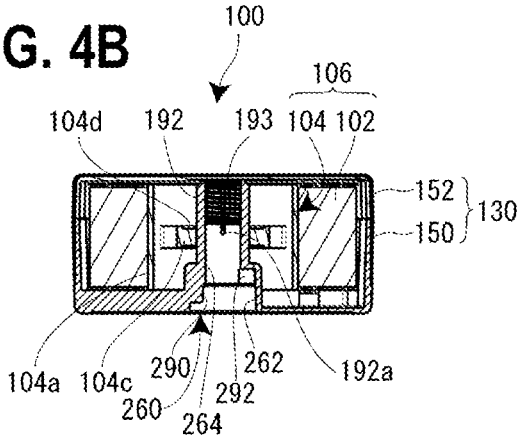
FIG. 4B illustrates a cross-sectional view taken along line B-B.

In the cartridge case 130 of the tape cartridge 100, when the tape cartridge is mounted on the tape printer 1, an insertion opening 134 through which the print head 21 is inserted is formed. The tape cartridge 100 also has a tape outlet 138 which is formed at the cartridge case 130 and through which the print tape 102 is sent. As details will be described below, the tape roll 106 is rotatably supported by a core shaft portion 192, which has a cylindrical shape and is provided to protrude inside the cartridge case 130 (see FIGS. 4A and 4B).

When the platen roller 120 and the winding core 116 are driven by the tape feeding mechanism unit 25, the print tape 102 is fed from the tape core 104 and the ink ribbon 110 is fed from the feeding core 112. The fed print tape 102 and the fed ink ribbon 110 run in parallel in a part of the platen roller 120 and are subjected to printing by the print head 21. A feeding end (printed part) of the print tape 102 is sent from the tape outlet 138 to the tape discharging port 17. Meanwhile, the ink ribbon 110 orbits a circumferential wall of the insertion opening 134 and is wound around the winding core 116. In the tape cartridge 100, plural types having different thicknesses are prepared depending on the tape width of the print tape 102.

[Details of Tape Printer]

Figure 5:
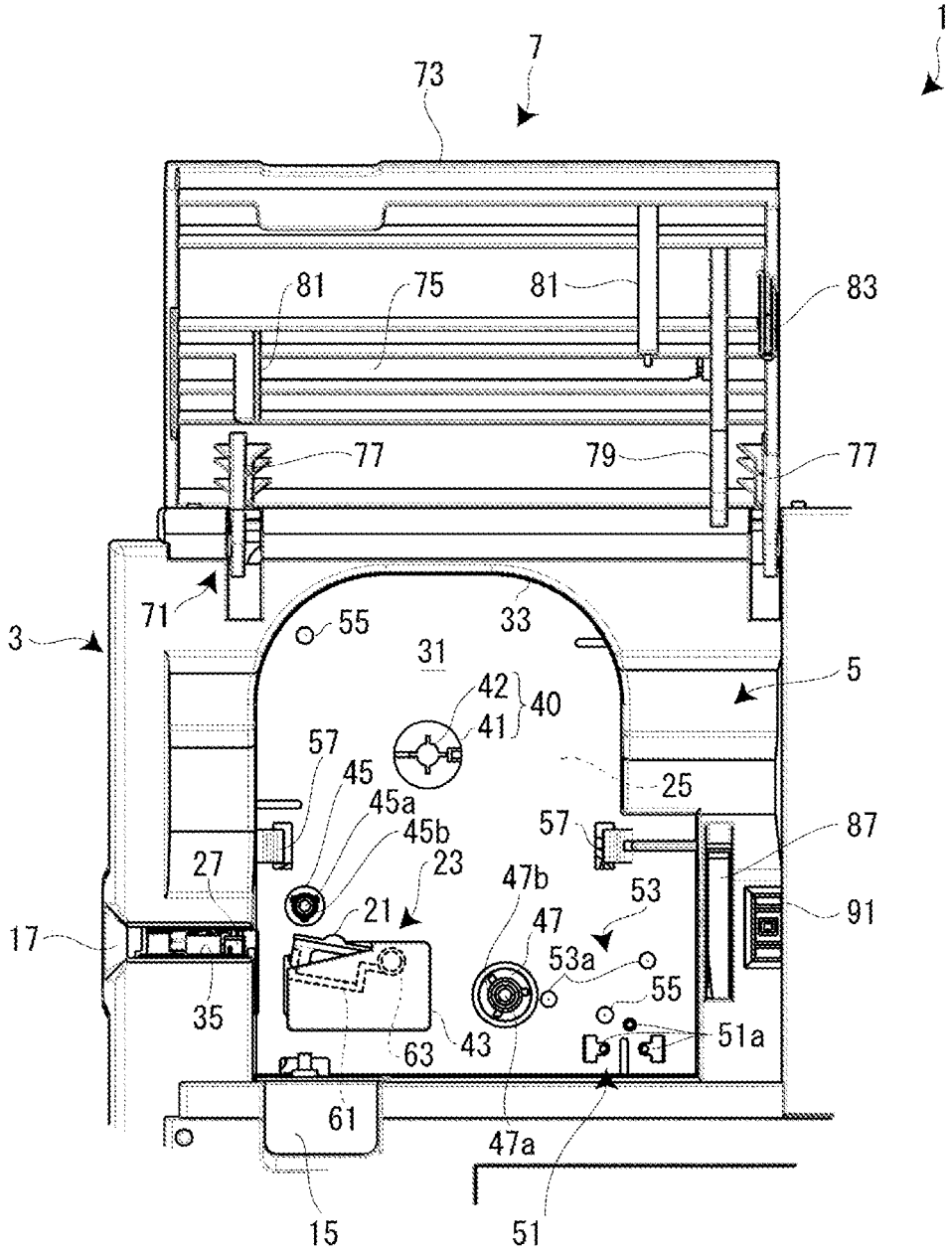
FIG. 5 is a plan view of a cartridge mounting section.

As illustrated in FIGS. 1 and 5, the cartridge mounting section 5 is hollowed to have a planar shape complementary to a planar shape of the tape cartridge 100, and to have a depth corresponding to the tape cartridge having the maximum thickness of the plural mountable types of the tape cartridge 100. In this case, a mounting base 31 and a side plate portion 33 constituting the bottom plate portion of the cartridge mounting section 5 are integrally formed (molded) with resin or the like. A slit-shaped tape discharging passage 35 is formed between the cartridge mounting section 5 and the tape discharging port 17, and the tape cutting mechanism unit 27 is built in this part.

When the tape cartridge 100 is mounted, a base convex portion 40, to which an inner circumferential portion of the core shaft portion 192 (see FIGS. 4A and 4B) of the tape cartridge 100 is fitted, is erectly disposed as an identification portion at the mounting base 31 of the cartridge mounting section 5. As will be described below in detail, the base convex portion 40 has a circular pedestal 41 erectly disposed on the mounting base 31 and an identification convex portion 42 erectly disposed on the pedestal 41.

The print head 21 covered with a head cover 43, a platen drive shaft 45 driving the platen roller 120, and a winding drive shaft 47 rotatably driving the winding core 116 are erectly disposed in the mounting base 31. A tape detection unit 51 that detects a type (property information) of the print tape 102 and a core release portion 53 that releases a rotation stop of the feeding core 112 and the winding core 116 are disposed in the vicinity of the winding drive shaft 47 in the mounting base 31.

In the mounting base 31, a pair of small protrusions 55 is disposed at diagonal positions and a pair of hooking pieces 57 which is hooked to the intermediate portion of the mounted tape cartridge 100 is additionally disposed. The tape feeding mechanism unit 25 having a motor and a gear train (both, not shown) rotating the platen drive shaft 45 and the winding drive shaft 47 are built in other space of the mounting base 31. The tape feeding mechanism unit 25 branches power into the gear train to synchronously rotate the platen drive shaft 45 and the winding drive shaft 47.

The print mechanism unit 23 has the print head 21 consisting of a thermal head, a head supporting frame 61 supporting and rotating the print head 21, a head release unit (not shown) and the head cover 43 rotating the print head 21 between a printing position and a retracted position via a head supporting frame 61, and the head cover 43 covering the head (and a head support frame 61).

The head release mechanism operates in conjunction with the opening and closing of the openable lid 7, moves (rotates) the print head 21 to a printing position in conjunction with the closing operation of the openable lid 7, and moves (rotates) the print head 21 to a retracted position in conjunction with the opening operation. The print head 21, which is moved to the printing position, is in contact with the platen roller 120 of the tape cartridge 100 via the ink ribbon 110 and the print tape 102, and the print head 21, which is moved to the retracted position, is separated from the platen roller 120. As a result, when attaching or detaching the tape cartridge 100, interference of the print tape 102 or the ink ribbon 110 on the print head 21 can be prevented.

Plural heating devices are disposed at the print head 21, and the plural heating devices are disposed in a line in a direction equal to the axial direction of the platen roller 120.

Printing is performed by feeding the print tape 102 and the ink ribbon 110 and selectively driving the plural heating devices. The head cover 43 is formed to have a generally-rectangular shape as a plan view and is integrally formed (molded) with the mounting base 31 (cartridge mounting section 5). The head cover 43 erectly protrudes from the mounting base 31, and thus rotation of the print head 21 is allowed the inside.

The tape detection unit 51 consists of plural micro switches 51*a*, and detects types, such as a tape width, a tape color, a material, of the print tape 102 by selectively engaging a detected portion 180 of the tape cartridge 100. Then, based on the detection result, drive of the print head 21 or the tape feeding mechanism unit 25 is controlled.

The core release unit 53 consists of two release pins 53*a* for the feeding core 112 and the winding core 116. As details will be described below, rotation stop hooks 206 which are respectively hooked to the feeding core 112 and the winding core 116 are disposed in the cartridge case 130 (see FIG. 6). When the tape cartridge 100 is mounted, the release pin 53*a* is engaged with this rotation stop hook 206, and thus the rotation stop of the feeding core 112 and the winding core 116.

Figure 8A:
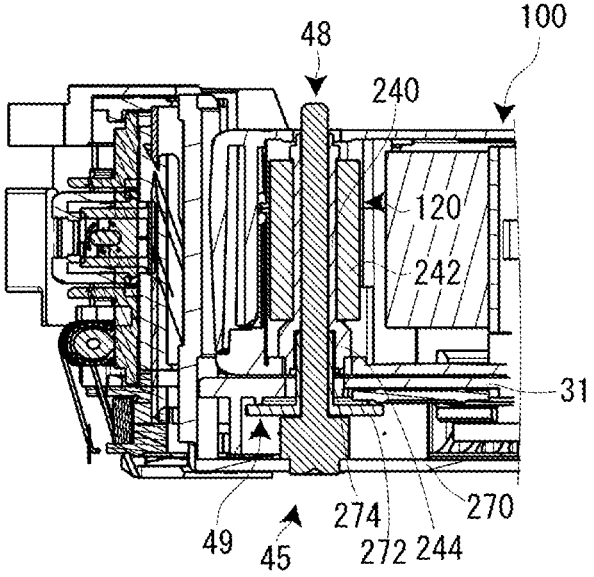
FIG. 8A illustrates an enlarged cross-sectional view of a platen drive shaft and a platen roller and FIG. 8B illustrates an enlarged view of a spline engagement portion.
Figure 8B:
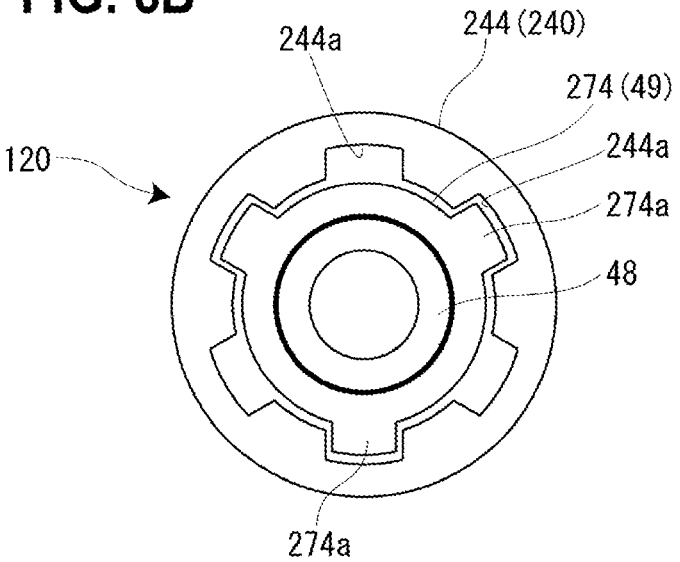

The platen drive shaft 45 has a fixing and supporting shaft 48 disposed to pass through the platen roller 120, and a spline-shaped spline drive shaft 49 (drive shaft) rotatably supported by a base of the fixing and supporting shaft 48 (see FIGS. 5, 8A and 8B). Rotational power of the tape feeding mechanism unit 25 is transmitted to this spline drive shaft 49, and then transmitted from the spline drive shaft 49 to the platen roller 120 (details will be described below).

Similarly, the winding drive shaft 47 has a fixing shaft 47*a*, and a spline-shaped movable shaft 47*b* rotatably supported by the fixing shaft 47*a*. In this case, the rotational power of the tape feeding mechanism unit 25 is transmitted to the movable shaft 47*b*, and then transmitted from the movable shaft 47*b* to the winding core 116.

When the tape cartridge 100 is mounted on the cartridge mounting section 5, the core shaft portion 192 (a core concave portion 260 described below) is engaged with the base convex portion 40 (see FIGS. 11A and 11B), the platen roller 120 is engaged with the platen drive shaft 45, and the winding core 116 is further engaged with the winding drive shaft 47. When the openable lid 7 is closed, the print head 21 is rotated and is in contact with the platen roller 120 via the print tape 102 and the ink ribbon 110, so that the tape printer 1 is a printing standby state.

Figure 6:
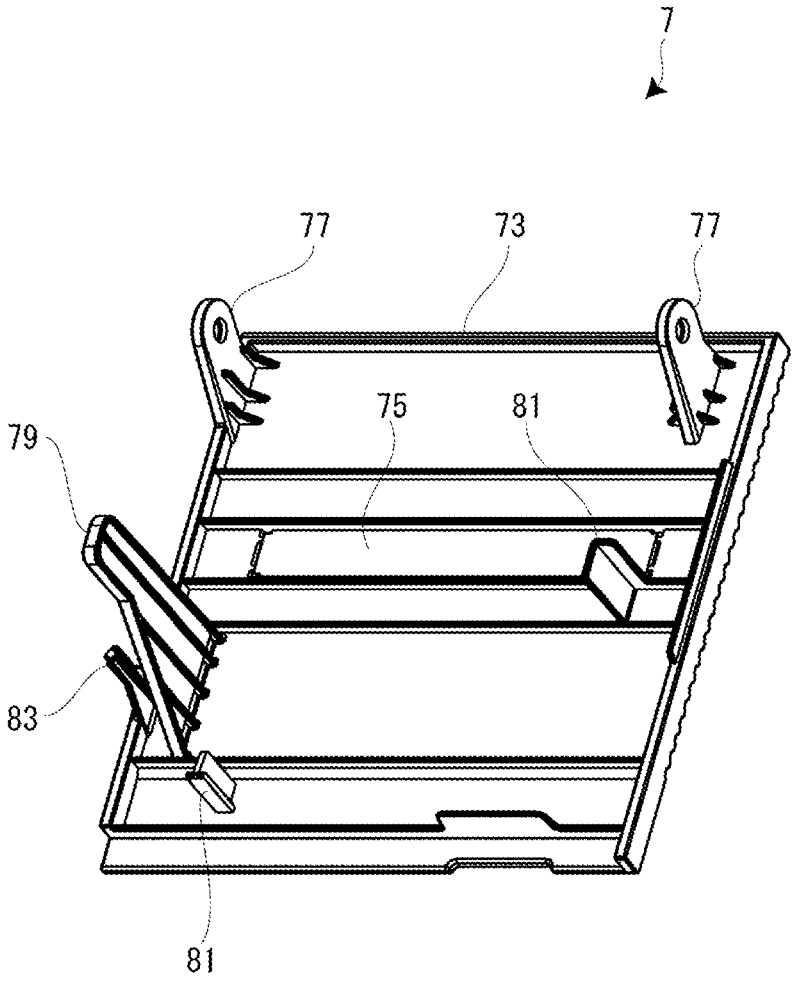
FIG. 6 is a perspective view of an openable lid when viewed from the bottom side.

As illustrated in FIGS. 1, 5, and 6, the openable lid 7 is rotatably, that is, openably, attached to the device case 3 via a hinge portion 71 disposed in the corner side. The openable lid 7 has an openable lid main body 73, and an observation window 75 formed at the center of the openable lid main body 73. The openable lid 7 has a pair of shaft supporting pieces 77 which protrude from the rear surface of the openable lid main body 73 and is rotatably supported by the hinge portion 71, and an actuating lever 79 which protrudes from the rear surface of the openable lid main body 73 and rotates the print head 21. The openable lid 7 has two push protrusions 81 which protrude from the rear surface of the openable lid main body 73 and push the tape cartridge 100, and a pressing protrusion 83 which protrudes from the rear surface of the openable lid main body 73 and turns ON a built-in lid closure detection switch (not shown).

The observation window 75 is horizontally formed and is made of a transparent (transparent to visible light) resin different from the openable lid main body 73. The tape cartridge 100 (types or remaining tape of the print tape 102) mounted on the cartridge mounting section 5 comes to be visibly recognized over the observation window 75. The pair of shaft supporting pieces 77, the actuating lever 79, the two push protrusions 81, the pressing protrusion 83, and the openable lid main body 73 are integrally formed (molded) by a resin.

The actuating lever 79 protrudes greatly from the rear surface of the openable lid main body 73, and is inserted in a slit passage 87 formed on the side of the cartridge mounting section 5 with a closure of the openable lid 7. The actuating lever 79 inserted in the slit passage 87 actuates the head release mechanism, and rotates the print head 21 toward the platen roller 120. Similarly, the pressing protrusion 83 is inserted in a rectangular passage 91 adjacent to the slit passage 87 with the closure of the openable lid 7, and turns ON the lid closure detection switch.

One push protrusion 81 corresponds to a position adjacent to the platen roller 120 of the tape cartridge 100, and the other push protrusion 81 corresponds to a position directly above the tape detection unit 51. When the openable lid 7 is closed, the two push protrusions 81 pushes the tape cartridge 100 to be mounted on the cartridge mounting section 5 and prevent the lift of the tape cartridge 100.

[Details of the Tape Cartridge]

The tape cartridge 100 will be described below in details with reference to FIGS. 2A to 4B, 7A, and 7B. In describing the tape cartridge 100, using FIG. 1 as an example, a front surface in the mounting direction of the tape cartridge, a back surface in the mounting direction, the left side surface, the right side surface, the top arc-shaped surface, and the bottom surface are referred to as the front, the back, the left side, the right side, the apical side, and the base side, respectively.

Figure 7A:
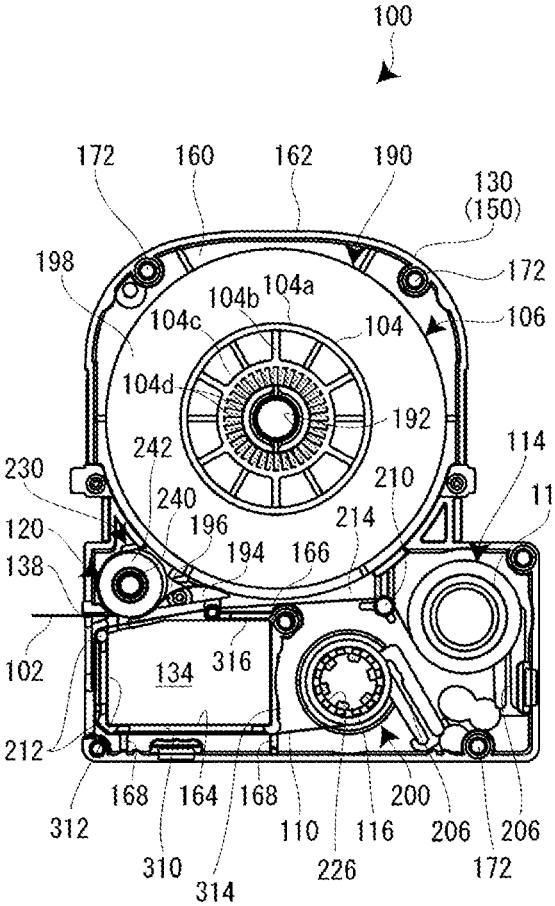
FIG. 7A illustrates a top view of an upper case and the tape cartridge of which the upper case is removed and FIG. 7B illustrates a bottom view of the upper case.
Figure 7B:
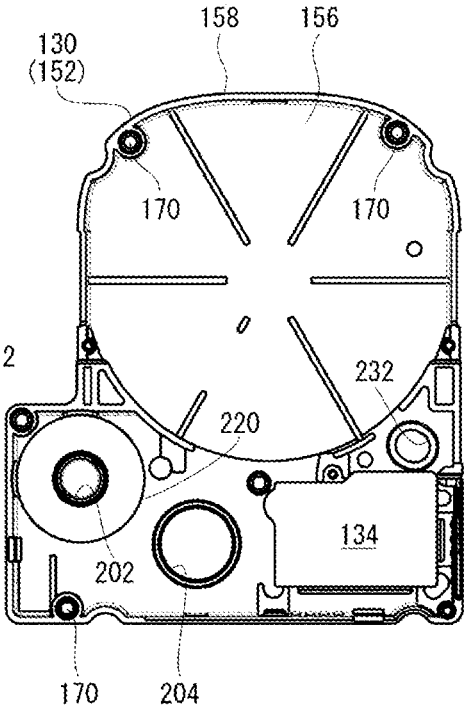

As described above, the tape cartridge 100 includes the cartridge case 130, and the tape roll 106, the ribbon roll 114, the winding core 116, and the platen roller 120 held therein (see FIGS. 7A and 7B). The tape cartridge 100 also includes the insertion opening 134 formed in the cartridge case 130, the tape outlet 138 formed at the left side in the vicinity of the platen roller 120, and an identification seal 141 (see FIG. 1) attached to over a surface of a site in which the tape roll 106 is held, the left side, and the right side. In the identification seal 141, the tape width, the color of the tape, the tape material or the like (a portion of property information) of the held print tape 102 are displayed on two sides of the front and the left side.

The cartridge case 130 constitutes an outer block of the tape cartridge 100 (shell structure) and the base side of the right side protrudes slightly, such that an "L"-shaped appearance is viewed from a plane. In the front and the back directions, when the tape cartridge is mounted on the cartridge mounting section 5, the cartridge case 130 has a lower case 150 corresponding to the back and an upper case 152 corresponding to the front. In the cartridge case 130 of the embodiment, the upper case 152 is composed of a molding of a transparent resin, and the lower case 150 is composed of a molding of a non-transparent resin The upper case 152 is integrally form (molded) with a top wall portion 156 constituting the front of the cartridge case 130 and an upper circumferential wall portion 158 vertically disposed at the periphery of the top wall portion 156. The lower case 150 is integrally formed (molded) with a bottom wall portion 160 constituting the back of the cartridge case 130, a lower circumferential wall 162 vertically disposed at the periphery of the bottom wall portion 160, and a passage circumferential wall portion 164 vertically disposed at the bottom wall portion 160 to define the insertion opening 134.

Plural joint pins 170 are formed to have an appropriate interval in the lower end side of the upper circumferential wall portion 158 of the upper case 152, and the plural joint holes 172 corresponding to the plural joint pins 170 are formed in the lower circumferential wall 162 of the lower case 150 (see FIGS. 7A and 7B). The tape cartridge 100 can be assembled by setting components, such as the tape roll 106 and the ribbon roll 114, in the lower case 150 and then joining the upper case 152 thereto in order to push the plural joint pins 170 to the plural joint holes 172. Each joint hole 172 has a through hole in consideration of easiness of molding.

Figure 2A:
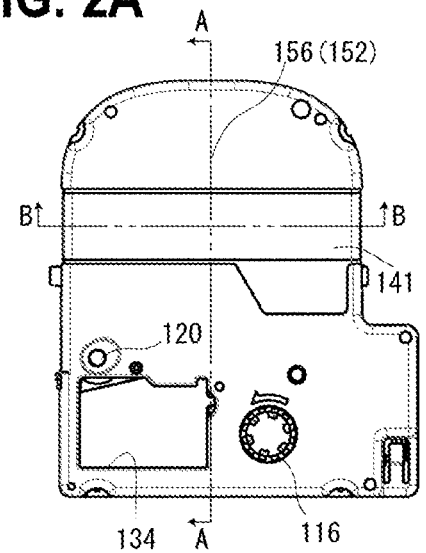
FIG. 2A illustrates a top view.
Figure 2B:
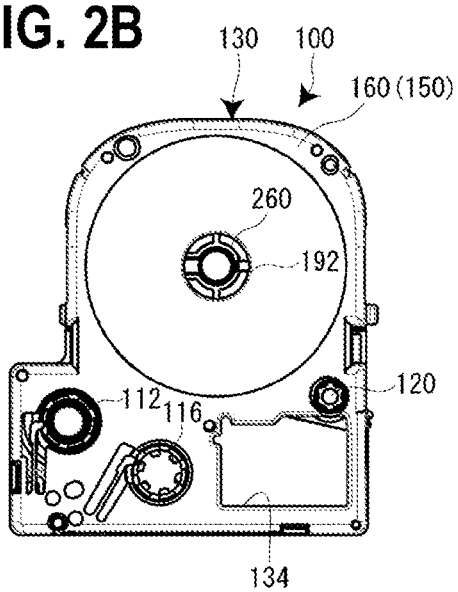
FIG. 2B illustrates a bottom view.
Figure 2C:
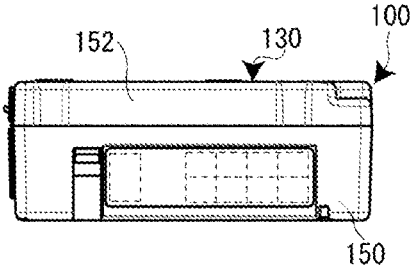
FIG. 2C illustrates a front view.
Figure 2D:
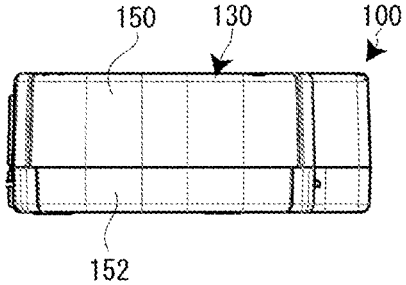
FIG. 2D illustrates a rear view.
Figure 2E:
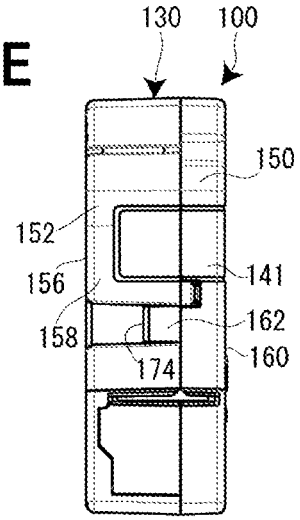
FIG. 2E illustrates a left side view.
Figure 2F:
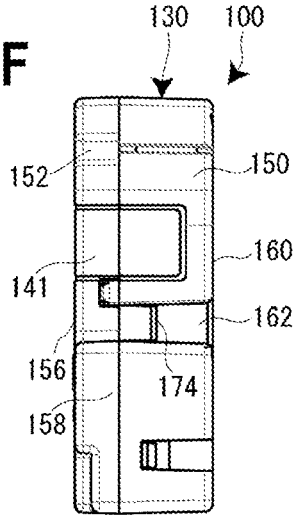
FIG. 2F illustrates a right side view, of a tape cartridge according to the embodiment.
Figure 3B:
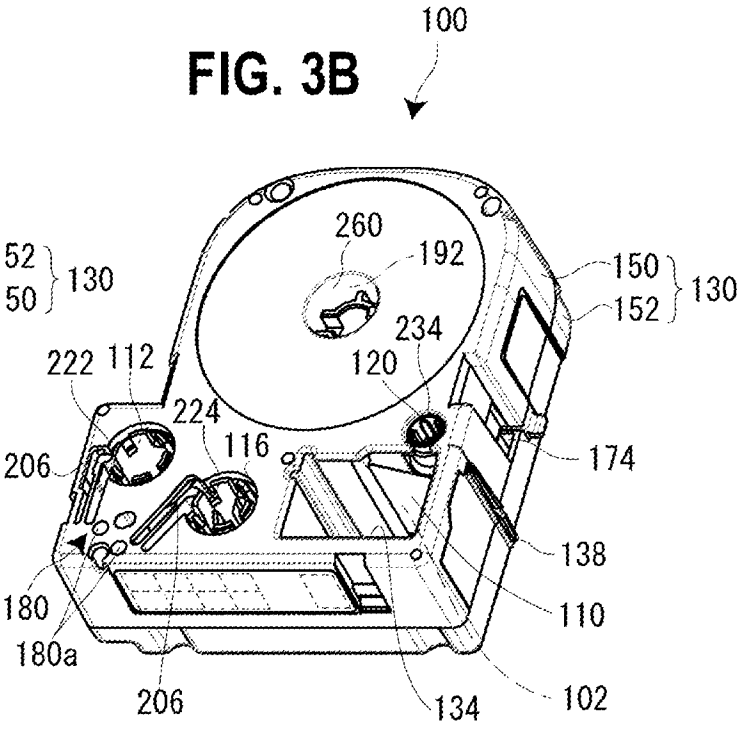
FIG. 3A illustrates a perspective view of the tape cartridge according to the embodiment when viewed from the top side and FIG. 3B illustrates a perspective view when viewed from the bottom side.
Figure 3A:
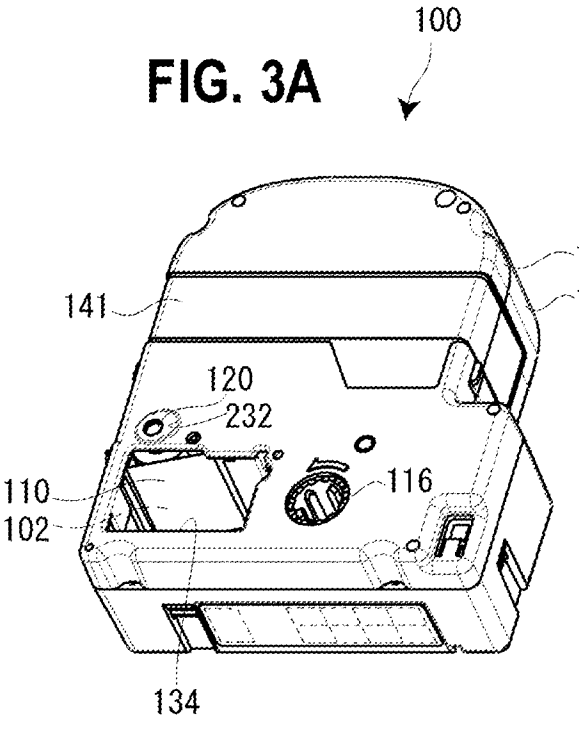

Meanwhile, a pair of hooking piece receiving portions 174 which receives the pair of hooking pieces 57 are formed in the left side and the right side of the lower case 150 (see FIGS. 2E and 2F and FIG. 3B). The pair of hooking pieces 57 of the cartridge mounting section 5 is hooked on the pair of hooking piece receiving portions 174 of the mounted tape cartridge 100, so that the lift of the tape cartridge 100 can be prevented. Small fitting holes 176 in which the pair of small protrusions are fitted with a little margin are formed in the back of the lower case 150 (see FIG. 3B).

A position of the tape cartridge 100 on the mounting base 31 is simply decided by fitting the pair of small protrusions 55 in the small fitting holes 176 of the mounted tape cartridge 100.

A detected portion 180, which is positioned at the left corner (right corner viewed from the front) of the base side and corresponds to the tape detection unit 51, is formed in the back of the lower case 150 (see FIG. 3B). The detected portion 180 is composed of parts corresponding to plural micro switches 51*a* of the tape detection unit 51, and plural bit patterns are obtained from presence or absence of receiving holes 180*a* formed in the parts.

That is, these bit patterns corresponds to types of the print tape 102.

As illustrated in FIGS. 4A, 4B, 7A and 7B, a tape receiving area 190, in which the tape roll 106 is widely received, is configured in an upper space (apical side) of the cartridge case 130. The core shaft portion 192 integrally formed (molded) with the lower case 150 is erectly disposed in the center of the tape receiving area 190. The core shaft portion 192 is formed to have a stepped cylindrical shape, and the tape roll 106 (tape core 104) is rotatably supported by the outer periphery 192*b* thereof (see FIGS. 4A and 4B).

While details is described below, a core concave portion 260, of which the inner circumferential side the base convex portion 40 is fitted in, is formed at the core shaft portion 192 having a fitting cylindrical shape. The core concave portion 260 has a depressed portion 262 in which the pedestal 41 of the base convex portion 40 is fitted, and an identification concave portion 264, in which the identification convex portion 42 is fitted, as the second fitting portion. A reverse stop spring 193 of the tape roll 106, the reverse stop spring composed of a coil spring, is built at the top of the core concave portion 260.

As illustrated in FIGS. 7A and 7B, a tape guide 194, which is positioned in the vicinity of the platen roller 120 and guides the fed print tape 102 to the platen roller 120, is integrally formed with the lower case 150 in the tape receiving area 190. That is, inside the cartridge case 130, a tape feeding path 196 is configured from the tape roll as a starting point to the tape outlet 138 through the tape guide 194 and the platen roller 120.

The print tape 102 fed from the tape roll 106 is guided to the platen roller 120 via the tape guide 194, and here is subjected to the printing, and is additionally guided from the platen roller 120 to the tape outlet 138.

The tape roll 106 has the print tape 102 and the tape core 104, and has two cylindrical films 198 adhered to both ends of the roll-shaped print tape 102. The two cylindrical films 198 prevent the print tape 102 wound around the tape core 104 from unraveling.

As illustrated in FIGS. 4A, 4B, 7A and 7B, the tape core 104 has a reel portion 104*a* which the print tape 102 is wound around and mounted to, and a rotary connecting portion 104*c* which is provided inside the reel portion 104*a* via plural inward ribs 104*b*, and is rotatably supported by the core shaft portion 192 with the rotary connecting portion 104*c*. Plural grooves 104*d* having a radially-shaped cross-section are formed in the cross section of the rotary connecting portion 104*c*, and thus the reverse stop spring 193 is configured to be disengaged to the cross-section grooves 104*d*. That is, a longitudinal slit 192*a* extending in the axial direction is formed in the top of the core shaft portion 192, so that wire end of the reverse stop spring 193 protrudes from the longitudinal slit 192*a* and is engaged with the cross-section grooves 104*d* of the rotary connecting portion 104*c*.

When the tape cartridge 100 is carried, reverse of the tape roll 106 (print tape 102) is prevented by the reverse stop spring 193. Meanwhile, when the tape cartridge 100 is mounted on the cartridge mounting section 5, the reverse stop spring 193 is compressed by the base convex portion 40 and the wire end is departed from the cross-section grooves 104*d* of the rotary connecting portion 104*c*, so that the reverse stop is released (see FIGS. 11A and 11B). As a result, the print tape 102 can be carried.

As illustrated in FIGS. 7A and 7B, a ribbon receiving area 200 is configured to be adjacent to the insertion opening 134 at the right side in the cartridge case 130. A feeding side bearing portion 202 rotatably supporting the ribbon roll 114 (feeding core 112) and a winding side bearing portion 204 rotatably supporting the winding core 116 are formed at the right side and the left side of the ribbon receiving area 200, respectively and are integrally formed with the cartridge case 130. That is, the feeding side bearing portion 202 and the winding side bearing portion 204 are formed at the upper case 152 and the lower case 150, respectively.

Rotation stop hooks 206, of which the distal portions are to face the feeding side bearing portion 202 and the winding side bearing portion 204, are integrally formed with notched parts of the feeding side bearing portion 202 and the winding side bearing portion 204 formed in the lower case 150. One rotation stop hook 206 and the other rotation stop hook 206 are engaged with the feeding core 112 and the winding core 116, respectively as a rotation stop state.

In the ribbon receiving area 200 adjacent to the feeding side bearing portion 202, a first ribbon guide 210, which guides the fed ink ribbon 110 to the platen roller 120, is erectly disposed at and integrally formed with the lower case 150. Plural second ribbon guides 212, which guide orbit of the ink ribbon 110, are integrally formed with the outer circumferential side of the passage circumferential wall portion 164.

Inside of the cartridge case 130, a ribbon feeding path 214 is configured from the ribbon roll 114 as the starting point to the winding core 116 through a first ribbon guide 210, the platen roller 120, and the plural second ribbon guide 212. The ink ribbon 110 fed from the ribbon roll 114 is guided to the platen roller 120 via the first ribbon guide 210, and here is subjected to the printing, and additionally orbits from the platen roller 120 to the passage circumferential wall portion 164 (the plural second ribbon guide 212) and is wound around the winding core 116.

The ribbon roll 114 has the ink ribbon 110 and the feeding core 112, and a ring-shaped plate spring 220 applying braking load to the feeding core 112 (see FIG. 7B). The plate spring 220 has a wave shape in the circumferential direction, and is interposed between the top wall portion 156 of the upper case 152 and the feeding core 112 in the axial direction. That is, rotation braking load due to resilient force of this plate spring 220 is applied to the feeding core 112. As a result, back tension is applied to the ink ribbon 110 fed by the winding core 116, and thus the slack can be prevented.

The feeding core 112 is formed to have a cylindrical shape and plural notches are formed in the end portion of the lower case 150 in the circumferential direction (see FIG. 3B). The rotation stop hook 206 is adapted to be disengaged from the plural notches 222. In addition, the feeding side bearing portion 202 which supports the feeding core 112 and in the side of the lower case 150 is configured to have a cylindrical passage, but the feeding side bearing portion 202 of the side of the upper case 152 is configured to have a cylindrically-shaped protrusion. The plate spring 220 is mounted on this protrusion (see FIG. 7B).

Similarly, the winding core 116 is formed to have a cylindrical shape, and plural notches 224 are formed in the end portion of the lower case 150 in the circumferential direction (see FIG. 3B). The rotation stop hook 206 is adapted to be disengaged from the plural notches 224. Spline-shaped slit grooves 226 are formed in the inner circumferential surface of the winding core 116, and splined and engaged with the winding drive shaft 47. As a result, a rotation force of the winding drive shaft 47 is transmitted to the winding core 116 to wind the ink ribbon 110.

A platen receiving area 230 is configured to be adjacent to the insertion opening 134 at the left side in the cartridge case 130. In the center of the platen receiving area 230, a lower bearing portion 234 of an ellipse-shaped opening formed in the lower case 150 (see FIG. 3B) and an upper bearing portion 232 of an ellipse-shaped opening formed in the upper case 152 (see FIG. 7B) are disposed. The platen roller 120 is supported as a rotatable and slightly-laterally movable state by the upper bearing portion 232 and the lower bearing portion 234. That is, the platen roller 120, which is supported by the upper bearing portion 232 and the lower bearing portion 234 having the ellipse shape, is configured to be laterally movable (slightly movable) between a home position with which the platen drive shaft 45 is engaged and a clamped position being contact with the tape guide 194 via the print tape 102.

This tape cartridge 100 may be carried in a condition in which a feeding end of the print tape 102 slightly protrudes outward through the tape outlet 138 (see FIG. 1). Here, if pushing force or pulling force is applied to the feeding end of the print tape 102 by mistake, the pulled platen roller 120 is moved to the clamped position. As a result, the feeding end of the print tape 102 is prevented from being drawn from the tape outlet 138 into the cartridge case 130.

The platen roller 120 has a cylindrical-shaped roller body 240, and a rubber roller 242 mounted on the outer circumferential surface of the roller body 240 (see FIGS. 8A and 8B). The rubber roller 242 has a length corresponding to the print head 21 in the axial direction, and thus, when moved to a printing position, the print head 21 is in contact with the print tape 102 and the ink ribbon 110 via the rubber roller 242.

A spline boss portion 244 is formed at the base portion of the roller body 240 as the first fitting portion, and the spline drive shaft 49 (drive shaft) of the platen drive shaft 45 is engaged with the spline boss portion 244 (see FIGS. 8A and 8B). As a result, the rotation force of the platen drive shaft 45 is transmitted to the platen roller 120 to print and feed the print tape 102 (and the ink ribbon 110).

[Structure of the Core Concave Portion and the Platen Roller]

Structures of the core concave portion 260 and the platen roller 120 of the tape cartridge 100 will be described below in detail together with the base convex portion 40 and the platen drive shaft 45 of the cartridge mounting section 5 with reference to FIGS. 8A to 11B. As described above, the platen drive shaft 45 and the base convex portion 40 are disposed at a distance in the cartridge mounting section 5, and the platen roller 120 and the core concave portion 260 corresponding to them are disposed in the tape cartridge 100.

As illustrated in FIG. 8A, the platen drive shaft 45 has a fixing and supporting shaft 48 erectly disposed at a device frame 270 positioned at the lower part of the mounting base 31, and a spline drive shaft 49 rotatably supported by the lower part of the fixing and supporting shaft 48. The fixing and supporting shaft 48 is fixed to the device frame 270 in a cantilever manner, and extends in an attachment/detachment direction of the tape cartridge 100 through the mounting base 31. The spline drive shaft 49 has a gear portion 272 of the base portion and a spline shaft portion 274 extending from the gear portion 272, and the gear train of the tape feeding mechanism unit 25 is coupled to the gear portion 272.

Meanwhile, as described above, the platen roller 120 has the rubber roller as the roller body 240, and the spline boss portion 244 is formed at the base portion of the roller body 240. That is, the spline boss portion 244, which is splined and engaged with the spline shaft portion 274, is disposed at the roller body 240.

When the tape cartridge 100 is mounted on the cartridge mounting section 5, the fixing and supporting shaft 48 of the platen drive shaft 45 is inserted through the roller body 240 of the platen roller 120. The spline shaft portion 274 of the platen drive shaft 45 is engaged with the spline boss portion 244 of the platen roller 120.

As illustrated in FIG. 8B, plural spline teeth 274 are formed at the spline shaft portion 274 in the circumferential direction, and plural spline grooves 244*a* corresponding to the plural spline teeth 274*a* are formed at the spline boss portion 244. In this case, unlike the structure of the conventional spline, the number of grooves of the grooves 244*a* is greater than the number of teeth of the spline teeth 274*a*. The plural spline grooves 244*a* have a distance in the circumferential direction wider than distance of the plural spline teeth 274*a* in the circumference direction. Specifically, the number of grooves of the spline grooves 244*a* is six, and the number of teeth of the spline teeth 274*a* is three, and thus the spline teeth 274*a* are engaged with the spline grooves 244*a* with a distance of one tooth. An inter circumferential base portion of the spline boss portion 244 is chamfered to have a guiding shape (see FIG. 8A).

In this way, the spline shaft portion 274 is smoothly fitted (engaged) in the spline boss portion 244 by the difference between the number of grooves and the number of teeth and the guiding shape of the spline boss portion 244. That is, the tape cartridge 100 is smoothly mounted on the cartridge mounting section 5.

Figure 9A:
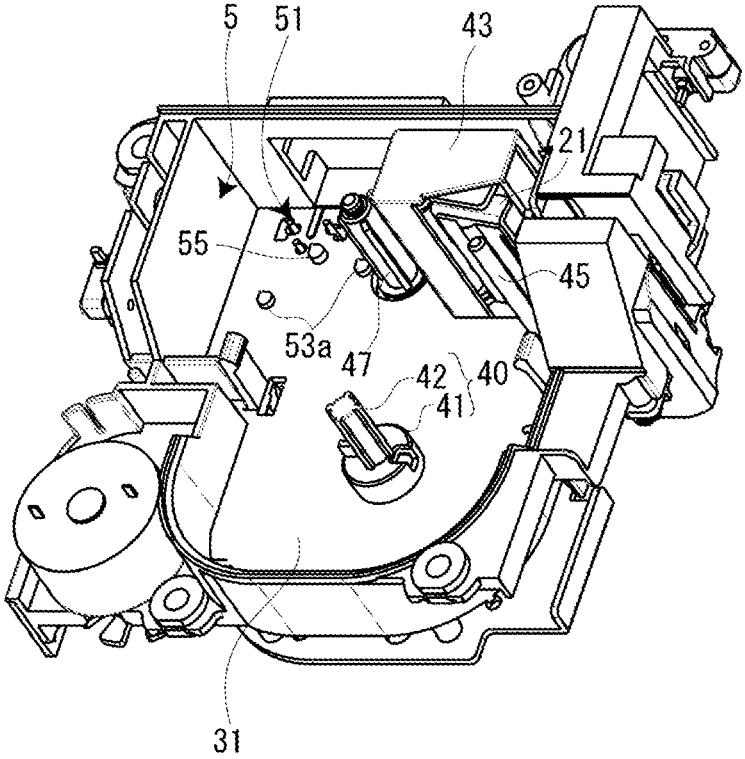
FIG. 9A illustrates a perspective view A of a cartridge mounting section and FIG. 9B illustrates an enlarged perspective view of surroundings of a base convex portion.
Figure 9B:
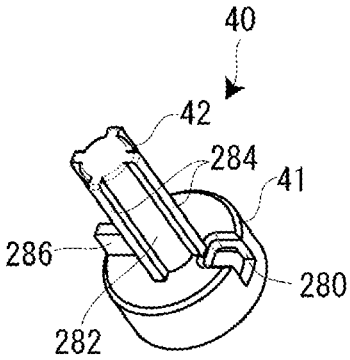
Figure 10A:
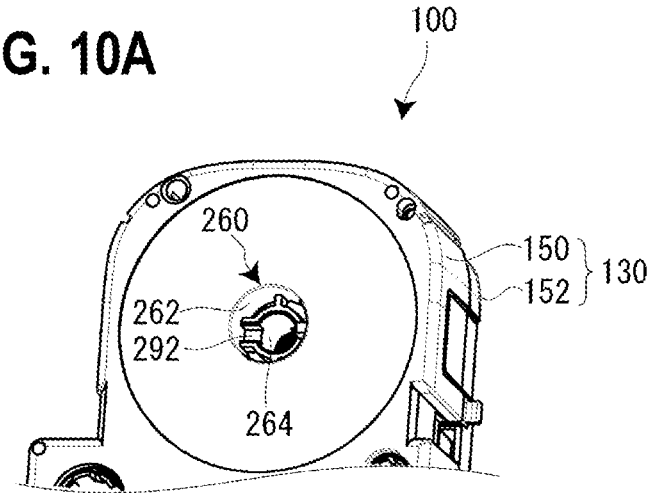
FIG. 10A illustrates an enlarged perspective view of the tape cartridge when viewed from the bottom-right side.
Figure 10B:
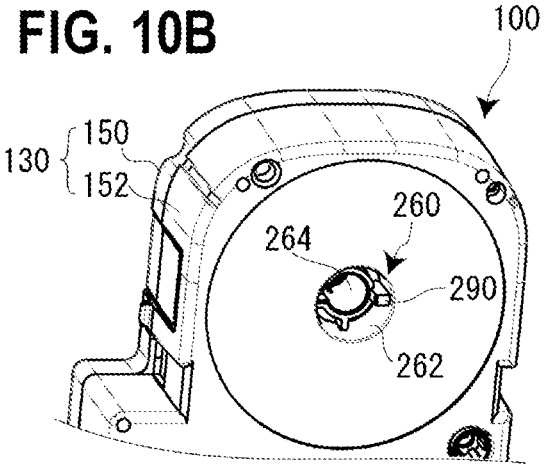
FIG. 10B illustrates an enlarged perspective view when viewed from the bottom-left side.
Figure 10C:
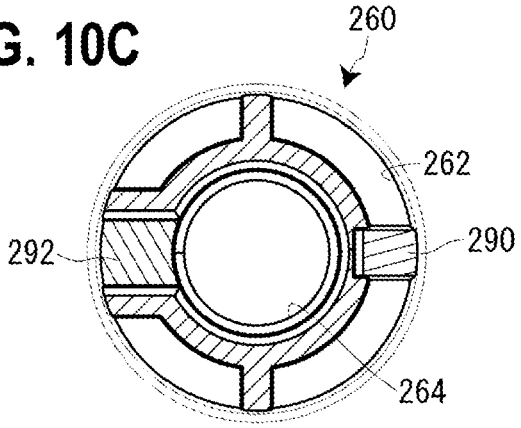
FIG. 10C illustrates an enlarged plan view of surroundings of a core concave portion.
Figure 11A:
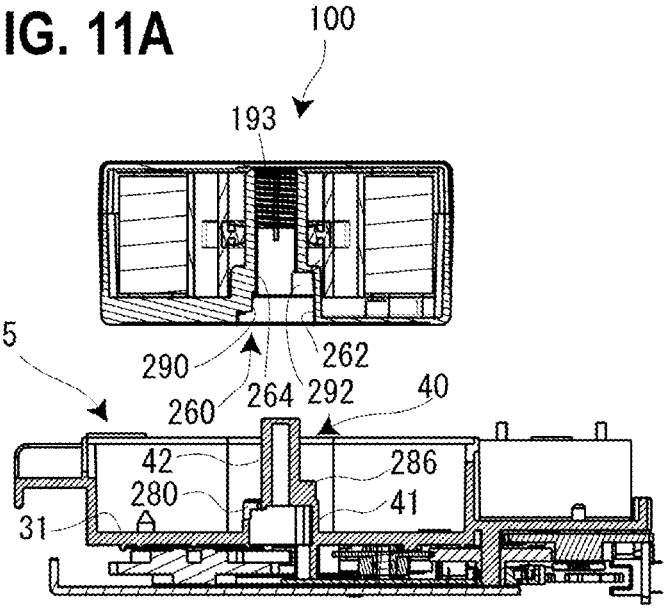
FIG. 11A illustrates a cross-sectional view of a state in which the tape cartridge is not mounted on the cartridge mounting section and FIG. 11B illustrates a cross-sectional view of a state in which the tape cartridge is mounted on the cartridge mounting section.
Figure 11B:
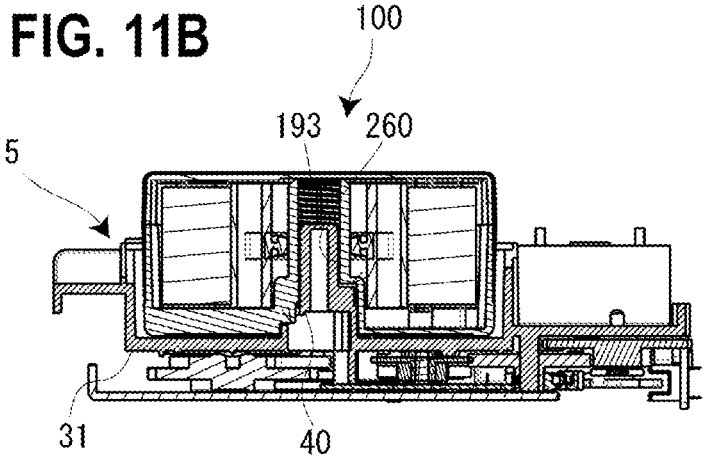

As illustrated in FIGS. 9A and 11B, the base convex portion 40 is integrally formed with the pedestal 41 erectly disposed on the mounting base 31 and the identification convex portion 42 erectly disposed on the pedestal 41. The pedestal 41 is formed to have a cylindrical shape, and has a notched opening 280 formed at a portion in the circumferential direction. The identification convex portion 42 has a cylindrical (hollow) convex body 282, four ridges 284 provided to form a cross shape on the outer circumferential surface, and a tongue piece 286 radially protruding from the convex body 282 along the top surface of the pedestal 41.

Meanwhile, as illustrated in FIGS. 10A to 10C, 11A and 11B, the core concave portion 260 has the depressed portion 262 in which the pedestal 41 of the base convex portion 40 is fitted, and the identification concave portion 264 in which the identification convex portion 42 is fitted. The depressed portion 262 and the identification concave portion 264 constitute an integrated space. A fitting convex portion 290 (protrusion) corresponding to the notched opening 280 is provided to protrude to the identification concave portion 264 in the axial direction. A fitting concave portion 292 corresponding to the tongue piece 286 of the identification convex portion 42 is provided at the identification concave portion 264 as immersive from the space.

When the tape cartridge 100 is mounted on the cartridge mounting section 5, the pedestal 41 of the base convex portion 40 is fitted in the depressed portion 262 of the core concave portion 260, and at the same time, the identification convex portion 42 of the base convex portion 40 is fitted in the identification concave portion 264 of the core depressed portion 260 (see FIGS. 11A and 11B). Together with this fitting, the fitting convex portion 290 is fitted in the notched opening 280, and the fitting concave portion 292 is fitted to the tongue piece 286.

In the tape cartridge 100 of this embodiment, the tape roll 106 is extremely heavy in the components, and the center exists in the vicinity of the tape core 104, when viewed from the plane. For this reason, in mounting the tape cartridge, unless it is specifically aware of gripping the tape cartridge 100, the tape cartridge 100 has a higher tendency in leaning at an angle. In such a case, prior to fitting the identification convex portion 42 in the identification concave portion 264, the identification convex portion 42 is likely to abut to the depressed portion 262, and thus an inclined posture of the tape cartridge 100 is corrected. That is, in mounting the tape cartridge, the tape cartridge 100 is corrected to a horizontal posture, and thus the mounting is smoothly performed (details will be described below). The center may be a geometric center or a center of gravity.

In this embodiment, identification of the type of the cartridge is performed by cooperation of the core concave portion 260 and the base convex portion 40. In this case, the type of the print tape 102 is not the type of the print tape 102 (type of the tape is checked by the tape detection unit 51), and, for example, identification of use (for industrial use and for home use), delivery region (for USA or EUROPE), or the like is performed.

For this reason, as not specifically shown, the tape cartridges 100 in which the position of the fitting concave portion 292 in the core depressed portion 260 is shifted in the circumferential direction, for example, in 90° pitch (lagged phase) and which has plural types depending on the delivery region (use), is adapted to be prepared. Accordingly, the tape printer 1 in which a phase of the tongue piece 286 in the base convex portion 40 is lagged and which has plural types depending on the delivery region (use) is adapted to be prepared (a first identification pattern).

In order to achieve plural types of the cartridge, a pattern in which a phase of the fitting convex portion 290 is lagged in the core depressed portion 260 (a pattern in which a phase of the notched opening 280 is lagged in the base convex portion 40) is also added (a second identification pattern). Instead of the phase lag (the first identification pattern and/or the second identification pattern) or in addition to the phase lag, shapes of the fitting concave portion 292 (tongue piece 286) or the fitting convex portion 290 (notched opening 280) may be changed.

As described above, according to the tape cartridge 100 of this embodiment, since the identification concave portion 264 is disposed in the depressed portion 262, in mounting the tape cartridge, prior to fitting the identification concave portion 264 to the identification convex portion 42 of the base convex portion 40, the identification convex portion 42 abuts to the depressed portion 262 and thus the posture of the tape cartridge 100 is corrected. For this reason, prior to fitting the identification concave portion 264 to the identification convex portion 42, a possibility of beginning to fit the spline boss portion 244 to the spline drive shaft 49 (spline shaft portion 274) can be increased. That is, in mounting the tape cartridge the tape cartridge 100, even though the mounting is begun with a slanted posture, it is possible to begin fitting of the spline boss portion 244.

It is accordingly possible to suppress an abnormal state that the spline boss portion 244 is stuck in the spline drive shaft 49 or the like. At the beginning of the mounting, an inclination or a position of the tape cartridge 100 can be corrected by preceding fitting of the spline boss portion 244 to the identification concave portion 264. An impact force in mounting the tape cartridge can be dispersed by making a difference in timing between beginning to fit the spline boss portion 244 and beginning to fit the identification concave portion 264. And thus, the tape cartridge 100 is smoothly mounted on the mounting section of the tape printer 1.

Since the identification concave portion 264 is disposed in the depressed portion 262, the identification concave portion 264 (core shaft portion 192) is made to have a substantially short length and thus have a moderate strength. The identification concave portion 264 is less likely to receive a direct impact force from drop impact or the like. Therefore, the identification concave portion 264 can be configured to have a structure hard to break. Even though protrusions such as the fitting convex portion 290 are present in the identification concave portion 264, the protrusions do not protrude from the outer surface of the tape cartridge 100. When the tape cartridges 100 are piled for storage, the fitting convex portion 290 or the like does not interfere with the piling.

[First Modified Example]

Figure 12A:
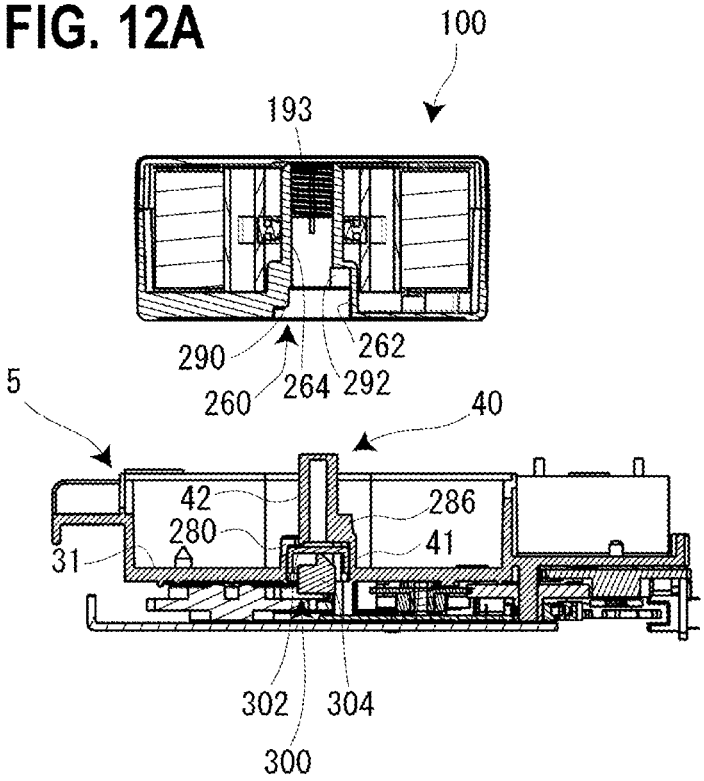
FIG. 12A illustrates a cross-sectional view of a state in which the tape cartridge is not mounted on the cartridge mounting section and FIG. 12B illustrates a cross-sectional view of a state in which the tape cartridge is mounted on the cartridge mounting section (a first modified example).
Figure 12B:
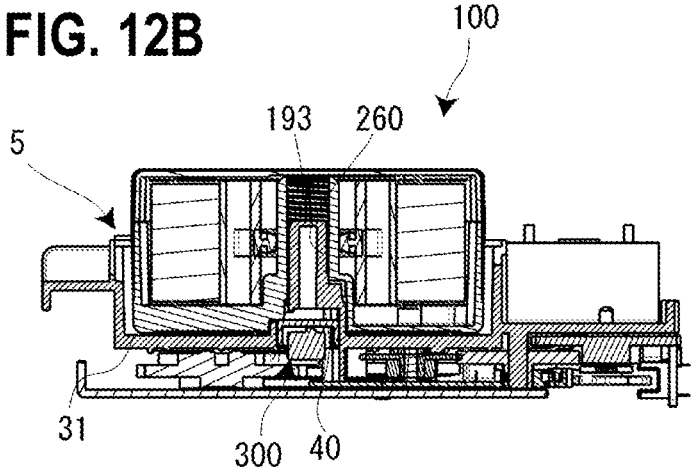

A first modified example will be described below with reference to FIG. 12. As illustrated in FIGS. 12A and 12B, in the first modified example, a cartridge detection unit 300 (actuated portion) is adapted to be built in the base convex portion 40. This cartridge detection unit 300 detects proper mounting of the tape cartridge 100 in the types of the cartridge 100 by actuating the fitting convex portion 290 of the core depressed portion 260 as an actuating portion. Therefore, in the first modified example, the fitting convex portion 290 also functions as a detected portion of the tape cartridge 100 side.

The cartridge detection unit 300 is built in the pedestal 41 of the base convex 40, and has an actuated member 302 actuating under the fitting convex portion 290 and a switch main body 304 being in contact with the lower side of the actuated member 302. The switch main body 304 is composed of a micro switch or the like provided in a fixed manner. The actuated member 302 is formed to have a cap shape, and provided on the inner circumferential surface of the pedestal 41 in a vertically movable state.

When mounting the tape cartridge 100 on the cartridge mounting section 5, the fitting convex portion 290 of the core depressed portion 260 is in contact with the actuated member 302 via the notched opening 280 of the base convex portion 40 to move this downward. Due to the downward movement of the actuated member 302, the switch main body 304 is turned ON and the mounting of the tape cartridge 100 is detected.

In this way, according to the first modified example, proper mounting of the tape cartridge 100 depending on a forwarding destination (usage) can be detected by providing the cartridge detection unit 300 inside the base convex portion 40. Since the cartridge detection unit 300 has a structure of actuating the switch main body 304 via the actuated member 302 and the actuated member 302 has a cap shape, even though a position or a shape of the notched opening 280 is changed to identify the cartridge, it is not necessary to additionally change the cartridge detection unit 300 side.

When a forwarding destination of the tape cartridge 100 is a delivery region (usage) such as a cold climate area is present, an operation of changing the tape printer 1 into a cold climate area mode or the like may be performed based on the detection result of the cartridge detection unit 300.

[Second Modified Example]

Figure 13A:
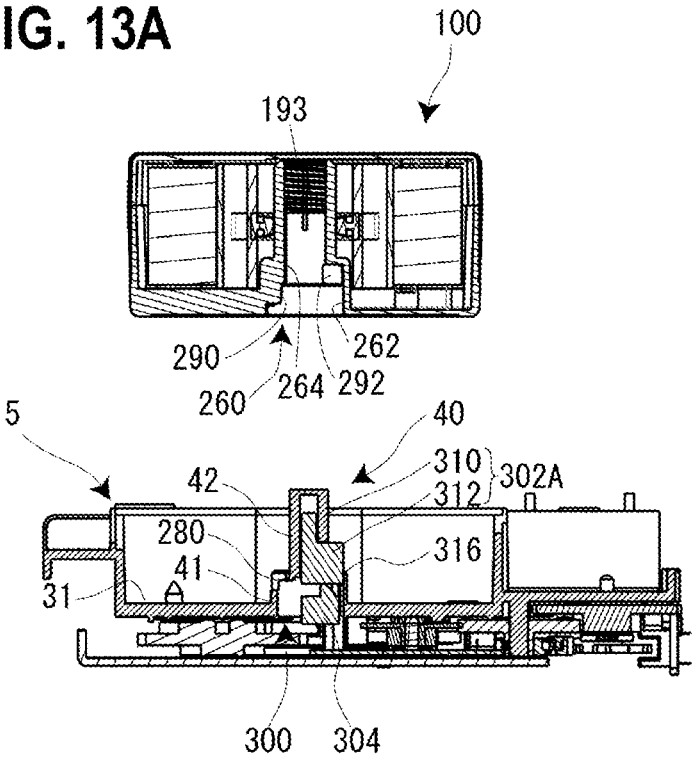
FIG. 13A illustrates a cross-sectional view of a state in which the tape cartridge is not mounted on the cartridge mounting section and FIG. 13B illustrates a cross-sectional view of a state in which the tape cartridge is mounted on the cartridge mounting section (a second modified example).
Figure 13B:
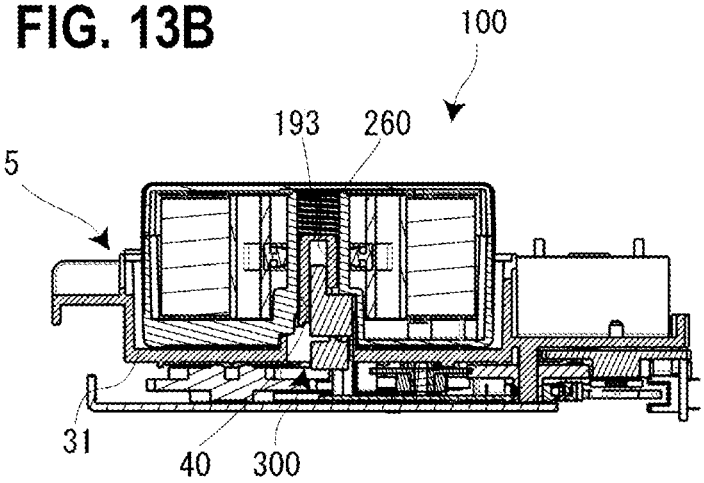

A second modified example of the embodiment will be described below with reference to FIG. 13. As illustrated in FIGS. 13A and 13B, in the second modified example, the cartridge detection unit 300 built in the base convex portion 40 has a structure in which the actuated member 302*a* also functions as the tongue piece 286. Therefore, in the second modified example, the fitting concave portion 292 of the core depressed portion 260 corresponding to the tongue piece 286 functions as a detected portion of the tape cartridge 100.

In this cartridge detection unit 300, the actuated member 302A is integrally formed with a shaft-like portion 310 and a tongue-like portion 312 also functioning as the tongue piece 286. The shaft-like portion 310 is provided in the inner circumferential surface of the convex main body 282 of the base convex portion 40 in a vertically movable state. The tongue-like portion 312 is provided at an L-shaped slit portion 316 ranging from the side of the convex main body 282 to the top surface of the pedestal 41 in a vertically movable state. In this case, an initial position of the tongue-like portion 312 is set to be higher than that of the tongue piece 286 in consideration of an actuating stroke.

When the tape cartridge 100 is mounted on the cartridge mounting section 5, (top surface of) the fitting concave portion 292 of the core depressed portion 260 is in contact with the tongue-like portion 312 of the actuated member 302A to move the actuated member 302A downward. Downward movement of this actuated member 302A turns ON the switch main body 304 to detect mounting of the tape cartridge 100.

In this way, according to the second modified example, proper mounting of the tape cartridge 100 depending on delivery region (use) can be detected by providing the cartridge detection unit 300 inside the base convex portion 40. The actuated member 302A has a structure also functioning as the tongue piece 286, and thus the number of components can be reduced.

What is claimed is:

1. A tape cartridge which is mounted on a mounting section of a tape printer, the tape printer having an identification portion configured to identify a type of a cartridge containing a tape-shaped printing medium, the tape cartridge comprising:

a tape roll around which the tape-shaped printing medium is wound;

a core shaft portion that is formed into a fitting cylindrical shape and has a rotation shaft of the tape roll;

an identification concave portion that is provided in an inner peripheral portion of the core shaft and engages with the identification portion;

a depressed portion that engages with a pedestal which is disposed on the mounting section; and a core concave portion that includes the identification concave portion and the depressed portion, wherein the identification concave portion is configured to accommodate the identification portion in a state where the tape cartridge is mounted on the mounting section.

2. The tape cartridge according to claim 1, wherein the identification portion has a convex body which is disposed on the pedestal and a tongue piece radially protruding from the convex body, and the identification concave portion has an engaging concave portion which corresponds to the tongue piece.

3. The tape cartridge according to claim 2, wherein when seen in an axial direction of the rotation shaft, the depressed portion has a circular shape and a diameter which is larger than the identification concave portion, and the engaging concave portion is disposed radially caving from the identification concave portion.

* * * * *